US005921621A

United States Patent [19]

Cook et al.

[11] Patent Number: 5,921,621

[45] Date of Patent: Jul. 13, 1999

[54] COLLAPSIBLE CHAIR

[76] Inventors: David G. Cook, 4120 S. Sullivan; Margaret J. Cook, 15515 E. 27th, both of Veradale, Wash. 99036

[21] Appl. No.: 09/120,034

[22] Filed: Jul. 21, 1998

[51] Int. Cl.[6] ..... A47C 4/38

[52] U.S. Cl. ..... 297/16.2; 297/34

[58] Field of Search ..... 297/16.2, 46, 51, 297/52, 380, 381, 382, 16.1, 354.1, 34, 42, 45

[56] References Cited

U.S. PATENT DOCUMENTS

| | | | |
|---|---|---|---|
| 180,610 | 8/1876 | Lungren | 297/16.2 X |
| 1,422,319 | 7/1922 | Stoll | 297/16.2 X |
| 2,352,090 | 6/1944 | Faller . | |
| 2,473,090 | 6/1949 | Becker . | |
| 2,712,349 | 5/1955 | Levoir . | |
| 2,722,973 | 11/1955 | Murcott . | |
| 3,124,387 | 3/1964 | Maclaren | 297/16 |
| 3,638,588 | 2/1972 | Abbott | 108/128 |
| 4,184,711 | 1/1980 | Wakimoto | 297/16 |
| 4,258,951 | 3/1981 | Groom | 297/16 |
| 4,290,643 | 9/1981 | Logan | 297/16 |
| 4,547,015 | 10/1985 | Wakimoto | 297/16 |
| 4,595,232 | 6/1986 | Glenn | 297/17 |
| 4,607,882 | 8/1986 | Opsvik | 297/195 |
| 4,671,566 | 6/1987 | Knapp | 297/16 |
| 5,362,130 | 11/1994 | Hoffman | 297/440.11 |
| 5,718,473 | 2/1998 | Lynch, Jr. | 297/16.2 |

*Primary Examiner*—Peter R. Brown

[57] ABSTRACT

A lightweight, collapsible chair with four legs supporting the corners of a square seat and a back cantilevered from a single leg, placed diagonally over and across the square seat, and positioned between the diagonal and the single leg so that the user straddles the front leg and places his body weight in the center of the seat, thereby contributing to chair comfort and stability.

3 Claims, 5 Drawing Sheets

COLLAPSIBLE CHAIR

BACKGROUND

1. Field of Invention

Figure 1:
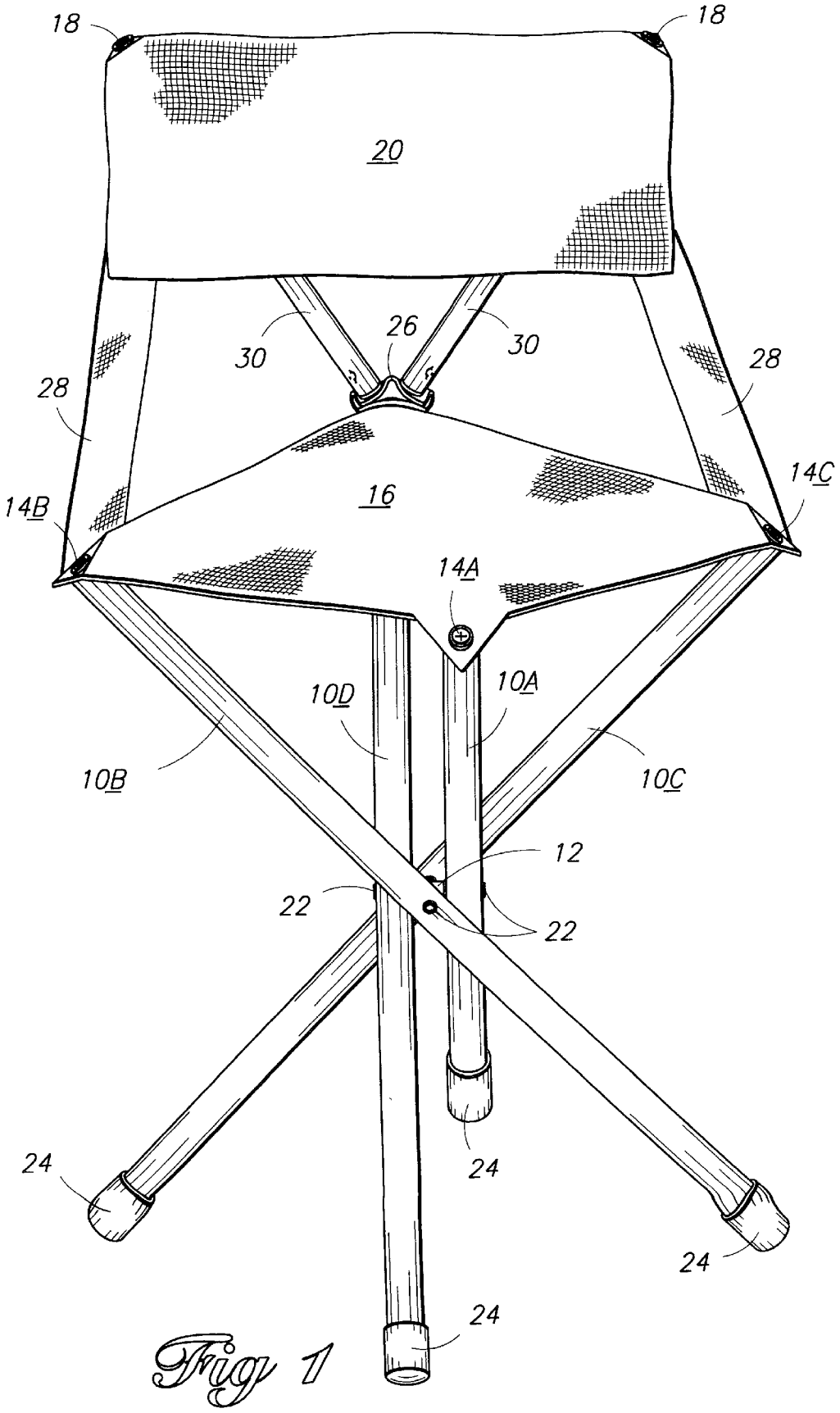

This invention relates to lightweight, collapsible stools and chairs used in camping, and other outdoor activities where easy portability is desired.

2. Description of Prior Art

Lightweight, collapsible stools and chairs are used in camping and other outdoor activities because they carry easily, stow compactly, and offer comfortable off-ground seating.

Some of the simplest devices for portable seating convenience have been three and four-legged stools with triangular or square seats. These simple designs offer low weight and good compactablity (i.e. maximum collapsibility) but lack long term comfort because they do not have any back support.

Four-legged chairs, which are more numerous in variety in prior art, show a constant trend to improve upon weight, compact-collapsibility, portability and comfort.

U.S. Pat. No. 2,353,090 to Faller (1944) is for a four-legged chair with an external center hinge with two front-to-back horizontal seat supports, and a back support shaped like an A-frame. Faller's design offers improved compactness and strength over prior art but the hard-surface A-frame is uncomfortable on the user's back.

U.S. Pat. No. 4,184,711 to Wakimoto (1980) is for another four-legged chair with the legs pivotally-coupled by an external center hinge and two back support uprights each hinged separately to a leg. Wakimoto's patent offers improved compactness over Faller's art by eliminating the horizontal seat supports. However, the external center hinge and the rigid back support tubes either interfere with free arm movement when angled out or cause discomfort as pressure on the fabric flexes the support tubes into the user's back. To minimize the before mentioned shortcomings the back support tubes and fabric are necessarily kept to a shortened size, thus describing and lessening the amount of support to the upper back.

U.S. Pat. No. 4,290,643 to Logan (1981) is a folding chair comprising a complicated network of eight rigid members, six tension cables, and a complex fabric cover. Although the closed bundle folds in a substantially parallel arrangement for collapsibility, the increased number of rigid members is not an improvement over prior art in terms of compact collapsibility. It also is not an improvement over prior art as to weight and ease of assembly.

U.S. Pat. No. 4,595,232 to Glenn et al. (1986) shows a four-legged chair with legs put together as two front-to-back X-shaped frames, two side-to-side horizontal seat supports connecting the X-frames, and two posts extending upright from leg sockets to hold a fabric backrest. A "spacer bar" reinforces the posts above the backrest to eliminate the flex of Wakimoto's art but adds a hard surface causing user discomfort. However, this design does not improve the collapsibility or lightweight features of existing art. Also, the rigid seat-front frame-member lies directly and uncomfortably under the user's legs.

There is another group of both three and four-legged chairs which are used in camping, and other outdoor activities. This group is sometimes referred to as "hammock style". (e.g., U.S. Pat. No. 2,712,349 to A. LeVoir (1951); U.S. Pat. No. 4,671,566 to Knapp (1987); and U.S. Pat. No. 5,362,130 to Hoffman (1994).)

These "hammock style" chairs suspend a full body-support sheet from lower legs in front to a higher leg or legs in the rear. Although comfortable once the user has reached the fully reclined position, a major shortcoming is their proximity to the ground making them difficult to get into and out of; and there is no direct support to specific parts of the user's anatomy. The hammock style chair frames are often heavy or cumbersome and not compactly collapsible.

Lightweight, collapsible chairs are characterized by small seats and short legs, which make a correspondingly small footprint, and with back supports positioned directly off rear legs. Therefore, stability becomes a factor when sitting on uneven ground or when tilting backward. With exception to the hammock style chair, including the Logan chair, the examples cited above are subject to reduced backward stability.

OBJECTS AND ADVANTAGES

Accordingly the objects and advantages of our collapsible chair are:

(a) to provide improved comfort by the use of an innovative back rest cantelevered and suspended over the diagonal of the seat. This unique back rest arrangement supports the user's body weight uniformly over a broad area of fabric with catenary action. In addition, the catenary forces used in suspending the back rest keep the rigid members of the back support essentially free from the users body which eliminates the discomfort of hard spots. Improved comfort has also been accomplished by the diagonal orientation of the chair seat. The user sits with one corner (the front seat corner) positioned between the user's legs. This sitting arrangement allows the user's legs, thighs and buttocks to contour to the seat without any rigid member contact. Furthermore, an additional seat layer is arranged to eliminate stretch across the middle of the chair seat for firm support further eliminating the need for other rigid support members.

(b) to provide lighter weight by reducing the number of rigid members and by reorganizing the geometry of the chair as mentioned above so that the user sits on the diagonal of the chair seat. Because the diagonal of a square seat is approximately 41% longer than one side, the comfort derived from the seating width in prior art can be maintained in our collapsible chair using a smaller square seat. Similarly, the cantilevered placement of the back rest uses only two rigid members for support and the catinary action allows for non-rigid suspension members which together have less bulk and weight. Our collapsible chair gives more support and comfort with less size and weight.

(c) to provide increased stability by the seat orientation and cantelevered back which locates the user's center of gravity away from the back of the chair thereby making our collapsible chair less susceptible to tipping than prior art.

(d) to provide improved compact collapsibility by the reduced number of rigid members and the improved hinging mechanisms over prior art. With only six rigid members and two innovative hinges, one flexible fabric hinge and one simple four-pin hinge, our collapsible chair has improved three dimensional folding capability and enhanced "nesting" of all components. The four-pin hinge is internally located at the center of the four legs and articulates them from the open chair frame to a position in parallel for a compact bundle. The flexible fabric hinge articulates the two rigid back support tubes from the top of one chair leg to a position in parallel to and nested between the chair legs. The fabric back rest and seat are nested within and around the parallel rigid members to complete the compact bundle in the collapsed state. A closure and carry device add the finishing touches for improved compactness over prior art.

Further objects and advantages are to provide improved convenience is accomplished by the fact that our collapsible chair can be used as a chair or stool with no loose parts and no assembly required. Also our collapsible chair is easy to use and understand. Still further objects and advantages will become apparent from consideration of the following description and drawing figures.

DRAWING FIGURES

FIG. 1 front perspective view of chair, ready for use

Figure 2:
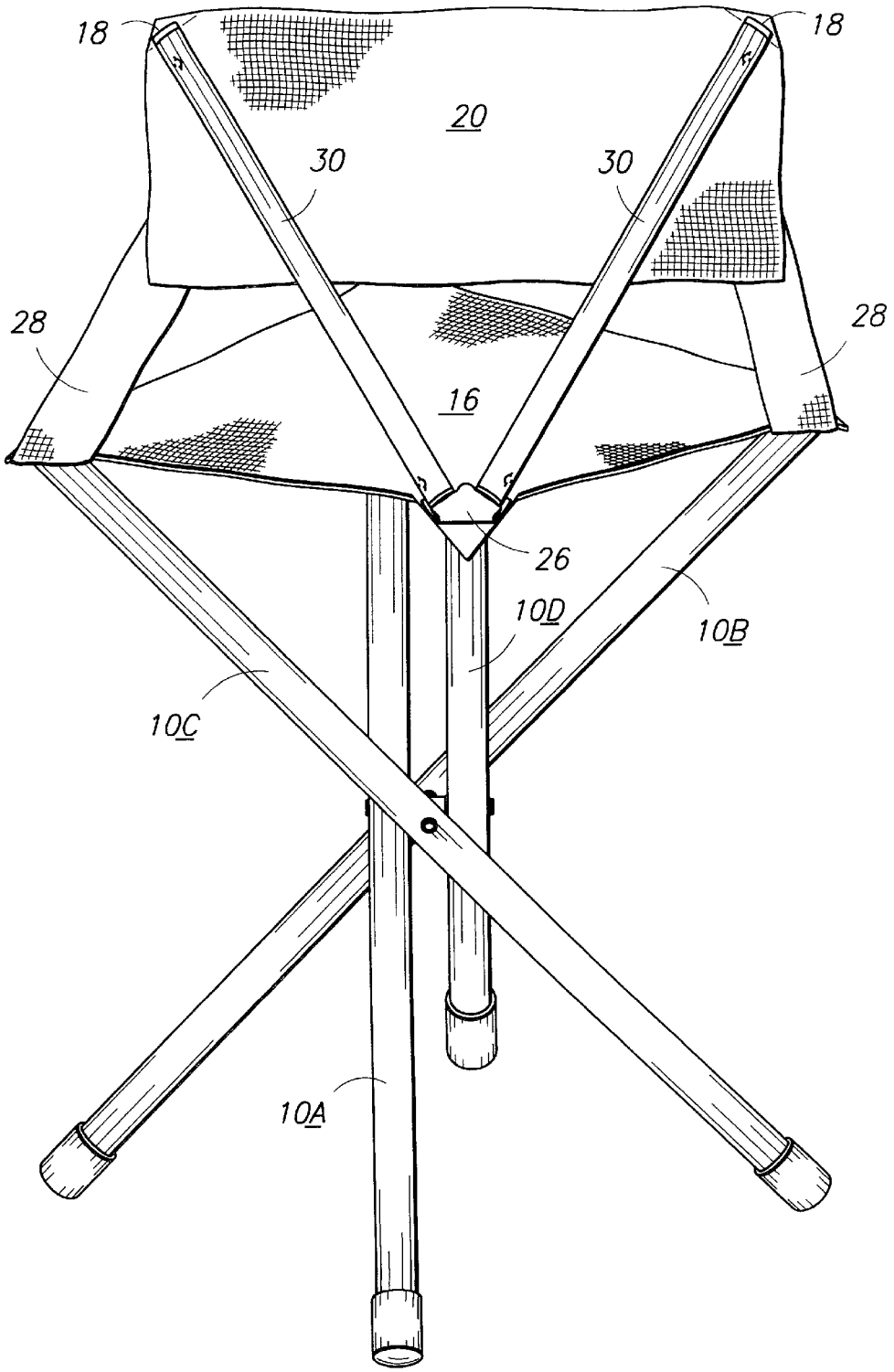

FIG. 2 rear perspective view of chair, ready for use

Figure 3:
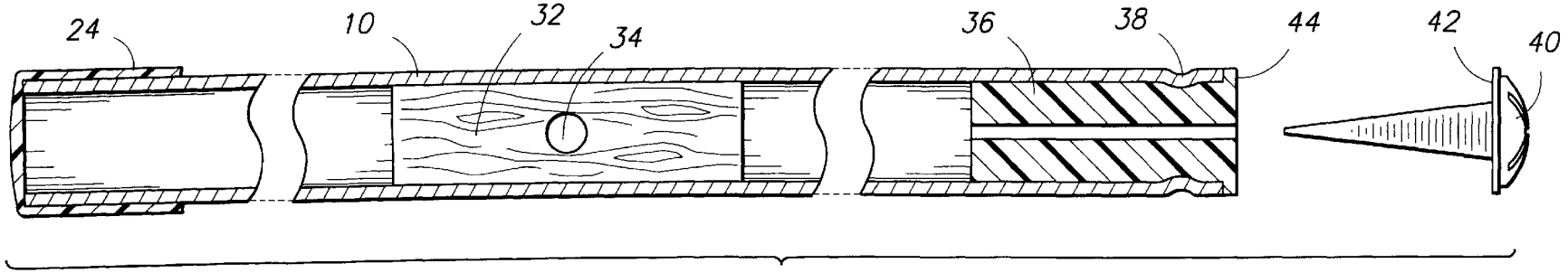

FIG. 3 side elevation of leg in cross section

Figure 4:
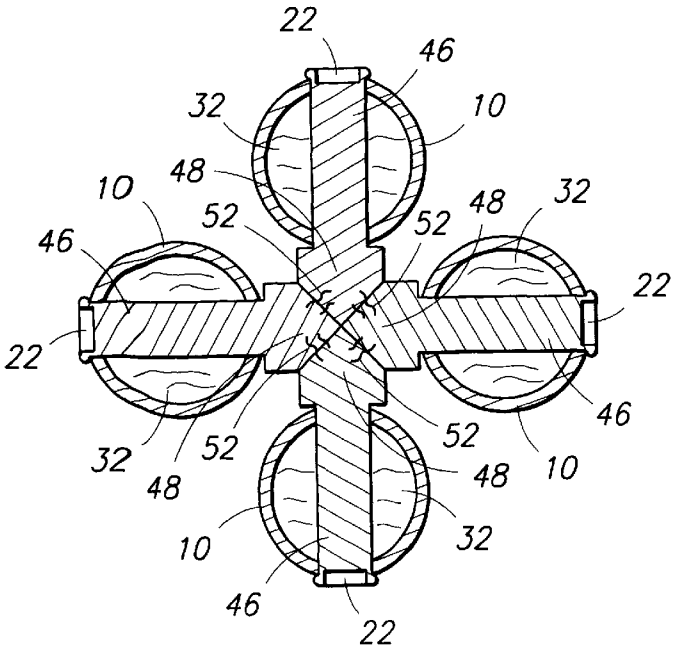

FIG. 4 plan view of four-pin leg connector

Figure 5:
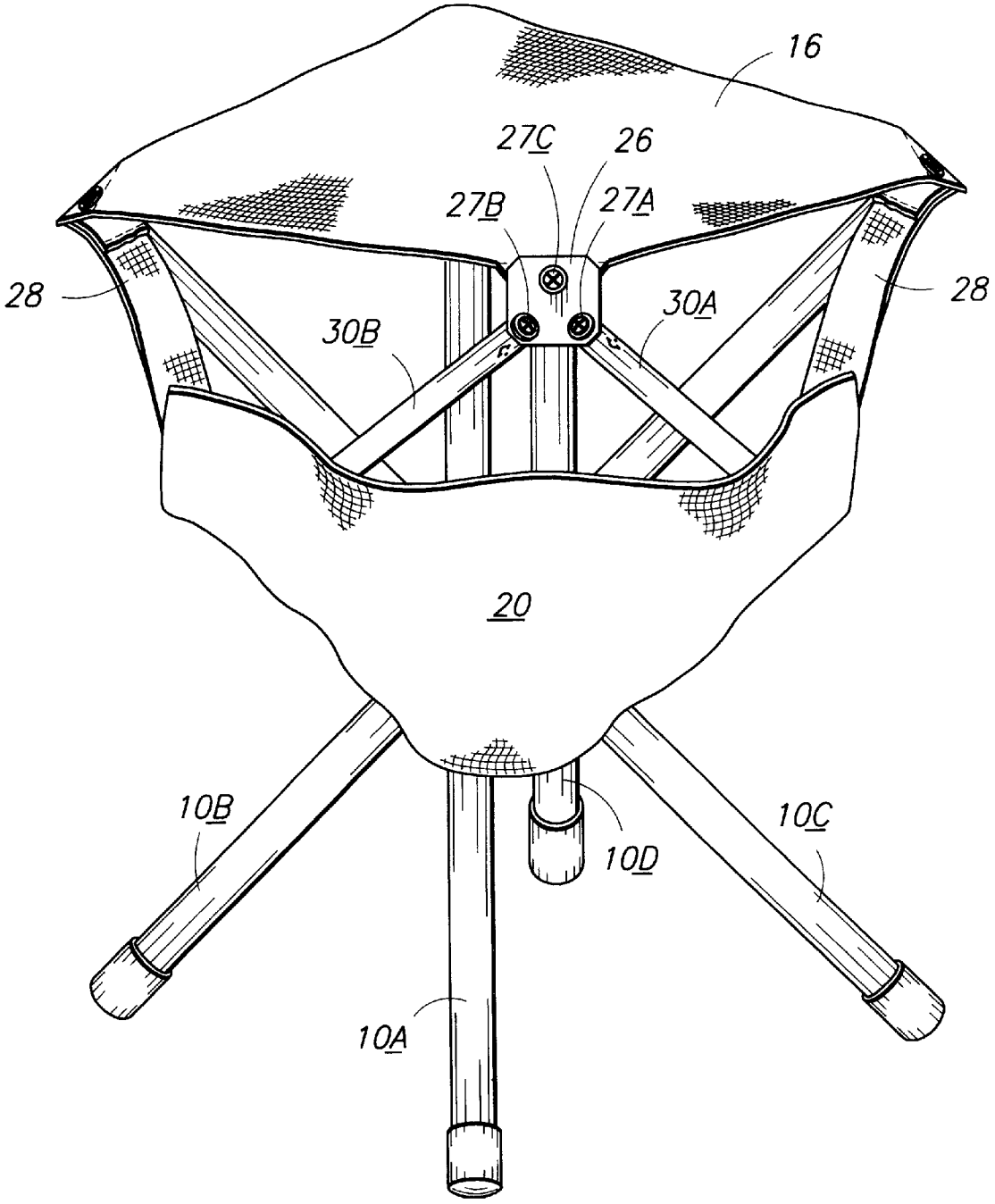
Figure 6:
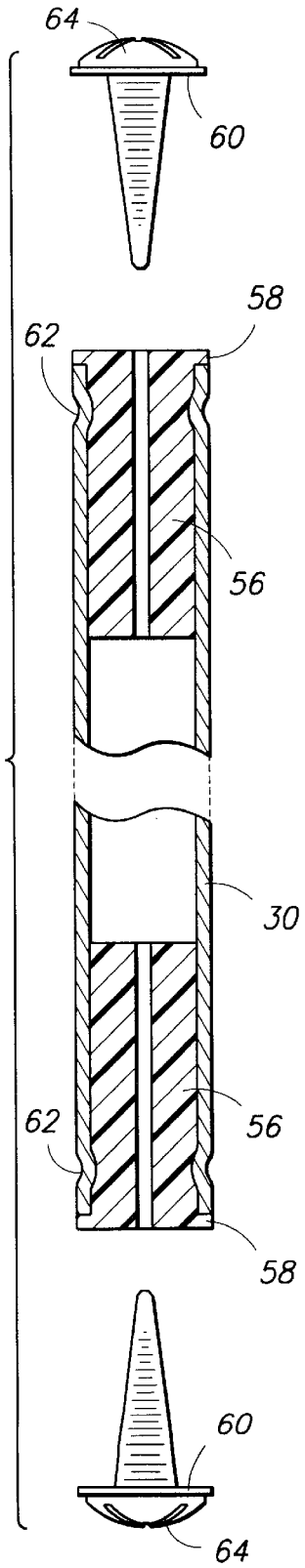
Figure 7:
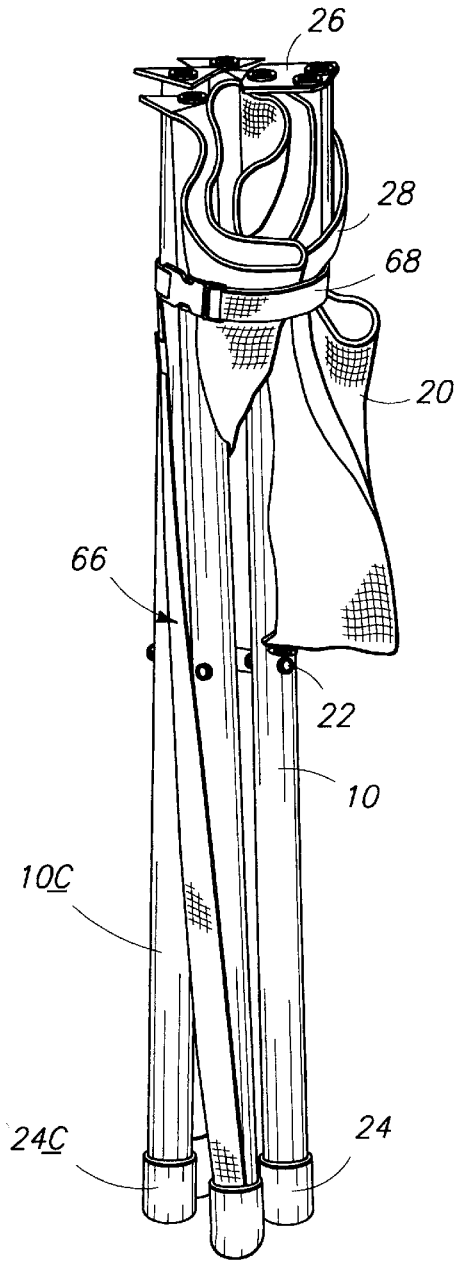

FIG. 5 rear perspective view of chair, back folded down, flexible fabric hinge open FIG. 6 side elevation of back support in cross section FIG. 7 side elevation of chair in closed bundle

REFERENCE NUMERALS IN DRAWINGS

10 tubular legs
12 four-pin pivotal-coupling leg connector
14 attachment points, leg to seat corner
16 seat
18 attachment points, back support tubes to backrest
20 backrest
22 peened ends of connector pins
24 resilient leg caps
26 flexible fabric hinge
28 backrest tie straps
30 back support tubes
32 long leg dowel
34 hole in leg & leg dowel
36 leg end-plug
38 leg plug staking
40 long leg screw
42 metal leg attachment washer
44 leg end-plug shoulder
46 connector pin
48 connector pin cone head
52 connector pin head welding
56 back support tube end-plug
58 back support tube end-plug shoulder
60 back support tube washer
62 back support tube end-plug staking
64 back support tube end-plug screw
66 adjustable shoulder strap
68 adjustable closure strap

DESCRIPTION—FIGS. 1 to 7

FIG. 1. shows the chair with four (aluminum) tubular legs (10A,B,C,D) internally pivotally coupled near their midpoints, and a square fabric seat (16). Top of front leg (10A) is attached to front corner (14A) of the seat (16) and at side attachment points (10B)(14B) and (10C)(14C). Top of rear leg (10D) is attached to rear corner of seat (16) at rear attachment point (14D). Attachment point (14D) is concealed in this drawing by closed flexible fabric hinge (26).

A four-pin leg connector (12) pivotally couples legs (10A,B,C,D). Peened ends (22A,B,C,D) of three of the four pins are shown. Fourth pin end (22C) is concealed by side leg (10C) in this drawing.

Resilient caps (24A,B,C,D) are placed over the lower ends of all four legs (10A,B,C,D) respectively.

The extent to which legs (10A,B,C,D) can be spread apart is limited by seat (16) 14.25 inch square. When legs (10A, B,C,D) are spread to their maximum, seat (16) is substantially a horizontal plane 19" from the ground.

To withstand the tension applied to seat (16), and to minimize "bottoming out" under a heavy occupant, the durable, fabric seat (16) is seamed 2.5 inches wide on all four sides and a mesh backing laid in diagonally. The mesh backing on underside of seat (16) is not shown. The weave of the mesh runs diagonally between attachment points (14B,C and 14A,D) uniformly supporting seat (16).

Backrest (20) hangs down in a plane with an approximate 10 to 20 degree slant from the vertical, placing the bottom edge of backrest (20) closer than its top edge to the front corner of seat (16).

The top and bottom edges of backrest (20) are also essentially parallel with the diagonal between side attachment points (14B) and (14C), and approximately halfway between the diagonal and rear attachment point (14D). In this drawing, rear attachment point (14D) is concealed by closed flexible fabric hinge (26).

Two backrest tie straps (28B,C) connect lower corners of backrest (20) to seat (16) and legs (10B,C) at attachment points (14B) and (14C) respectively.

Two screwheads are shown at upper corners of backrest (20). These mark attachment points (18A,B) for the two upper ends of back support tubes (30A,B). In this drawing, only the lower portions of back supports (30A,B) can be seen through space between backrest (20) and seat (16).

FIG. 2. is a view from the back of the chair. It shows two slanted tubular back support tubes (30A,B) with lower ends fastened adjacently on flexible fabric hinge (26) at (27A,B). From this common base on hinge (26), back supports (30A,B) spread apart in a wide V formation as they rise to attachment points (18A,B) at the upper corners of backrest (20).

Flexible fabric hinge (26) is closed in this view, folded forward to position back support tubes (30A,B) at angle over seat (16). Fold on approximate center-line of closed flexible fabric hinge (26) is seen in this drawing. This drawing also shows back support tubes (30A,B) attached to flexible fabric hinge at attachment points (27A,B).

Back support tubes (30A,B) not only spread apart from each other as they rise, but also angle forward to position backrest (20) in its cantilevered position. The forward slant supports the catinary actions when chair is in use and reduces the possibility of discomfort to chair occupant from intrusion of rigid stuctures on the body.

FIG. 3. shows a cross section of aluminum tubular leg (10). A long dowel (32) inserted midway in leg (10) reinforces tubular resistance to the bending moment of any force exerted on leg (10) by the weight of the chair occupant. All legs (10A,B,C,D) are reinforced.

Dowel (32) also serves as backing to the wall of leg (10) so that pin from four-pin leg connector (12) (not shown), penetrating both leg (10) and dowel (32) through predrilled hole (34) can be peened without significant dimpling or weakening of leg (10).

End plug (36) is inserted in the upper end of leg (10) and staked in place (38). End plug (36) receives screw (40)

which compresses and holds any fabric sandwiched between metal washer (42) and shoulder (44) of end plug (36).

The positive attachment made by compression between metal washer (42) and end plug shoulder (44) is the same whether it is only for seat fabric at front attachment point (14A) or a combination of seat fabric and backrest tie strap fabric at side attachment points (14B) and (14C) or for a combination of seat fabric and flexible fabric hinge (26) at rear attachment point (14D).

End plug shoulder (44) as part of end plug (36) fits precisely at the upper end of leg (10) and protects layers of compressed fabric from being cut by bare metal at the upper end of leg (10).

Resilient cap (24) holds itself around the lower end of leg (10) by its inherent elasticity.

FIG. 4. is a plan view in cross section of four-pin leg connector (12) that pivotally couples four aluminum tubular legs (10) in the midpoint area where legs (10) are reinforced by four dowels (32).

Large cone heads (48) on all four connector pins (46) are welded at multiple points (52) into a unified connector head approximately 0.9 inches, small enough to save weight and bulk, but large enough to space legs (10) so that they will swing freely as they spread apart and stretch seat (16) taut.

Legs (10) are hung from connector pins (46) prior to pins being peened at ends (22).

When seat (16) has been pulled flat, it becomes a positive stop to any further spread of legs (10) preventing them from binding on each other.

FIG. 5. is a perspective view of the chair from the rear. It shows backrest (20) folded below the plane of seat (16), and substantially under seat (16) itself. Backrest (20) hangs loosely from back support tubes (30A,B) and backrest tie straps (28A,B).

In this view there is nothing above the seat (16) except unfolded or opened position of flexible fabric hinge (26). The chair is substantially a four-legged stool, and could be so used.

Opened flexible fabric hinge (26) reveals three screw-heads. Rear leg (10D) attachment point (14D) to seat (16) attaches to flexible fabric hinge (27C) seen as screw head at the top in this drawing. Two back support tubes (30A,B) attachment to flexible fabric hinge attachment points (27A, B) seen as two screwheads at the bottom and adjacent to each other of drawing.

Back support tubes (30A,B) angle down and away from each other and backrest (20) and backrest tie straps (28A,B) hang down under seat (16). For the considerable flexing involved, fabric hinge (26) must be protected from tearing. Fabric must be left intact around each of the three attachment points, one at (14D) and two at (27A,B). Here, the three attachment points (27A,B,C) are spaced a minimum of 1¼ inches apart, center to center, and approximately 0.5 inches from the center of any attachment points (27A,B,C) to the closest edge of flexible fabric hinge (26).

Adequate tensile strength of flexible fabric hinge (26) is obtained here from four to five thicknesses of 20×20 threads per inch, 1000 denier polyester vinyl-coated fabric heat-sealed into a resilient sheet approximately ⅛ inch thick.

FIG. 6. is a side elevation of tubular aluminum back support tube (30) in cross section. Because virtually no bending force is exerted on back support tubes (30A,B) their diameter is substantially smaller than the diameter of legs (10).

End plug (56) is inserted at each end of back support tubes (30) and staked in place (62). Shoulder (58), a part of end plug (56), protects backrest fabric (20) at one end, and flexible fabric hinge (26) at the other end from being cut by a raw metal tube.

Back support tubes (30) are bilaterally symmetrical, either end can be attached to fabric hinge (26). The opposite end is then be attached to a top corner of backrest (20) at attachment point (18).

The attachment at both ends of back support (30) is similar to that at attachment points (14A,B,C,D) where seat corners are fastened to legs (10). Backrest fabric (20) or flexible fabric hinge (26) is sandwiched between metal washer (60) and end plug shoulder (58) by compression from screw (64) as it is turned into end plug (56).

FIG. 7. is side view of chair in closed bundle. Legs (10A,B,C,D) are parallel in pivotally-coupled, closed state. Flexible fabric hinge (26) is fully open. Back support tubes (30A,B) are nested to legs (10A,B,C,D) with backrest (20) folded, and wrapped under back supports (30) and around legs (10). Seat (16) is folded, and compressed inside, and between legs (10). Ends of adjustable shoulder strap (66) attach at attachment point (14C) at top end, and leg (10C) under resilient leg cap (24C) at bottom end. Adjustable closure strap (68) attached to adjustable shoulder strap (66), at a point approximately five inches below top of leg (10C), secures seat (16), backrest (20), back supports (30) and legs (10) in a compact collapsed bundle.

OPERATION—FIGS. 1 to 7

The chair carried to the campsite as a compact collapsed bundle consists of four legs (10) and two back supports (30), nested substantially as a parallel assembly, with seat (16) nested within and around top ends of legs (10), and both backrest (20) and backrest tie straps (28) partially rolled around all other parts.

The first step in preparing the chair for use is to lift and fold backrest (20), backrest tie straps (28) and back supports (30) up and over legs (10) before legs (10) are then spread apart.

This action folds flexible fabric hinge (26) into its closed and positively stopped position so that back supports (30) are free to angle apart and forward as they cantilever backrest (20) over and above seat (16) and suspends back-rest tie straps (28) to seat attachments (14B) and (14C).

The second step is to spread legs (10) apart as far as possible, at which time seat (16) will be stretched taut between opposite pairs of attachment points (14A,B,C,D).

Stretching seat (16) taut simultaneously pulls backrest tie straps (28) away from each other and backrest (20) into final position ready for the chair user.

Turning the chair once more into a compact collapsed bundle exactly reverses the previous procedure. First legs (10) are pivoted to parallel, with seat (16) tucked down between their tops, nesting close to parallel.

Back supports (30), backrest (20), and backrest tie straps (28) are then easily lifted and folded down, around, and below the tops of legs (10).

Flexible fabric hinge (26) is completely open at this point and allows back supports (30) to be nested with legs (10). Back rest (20) and backrest tie straps (28) are partially wrapped around the six rigid elements (four legs (10) and two back supports (30)).

The compact collapsed bundle can then be secured with closure buckle and carried easily with its own shoulder strap (68).

We claim:

1. A lightweight, collapsible chair comprising:

a) a substantially square flexible seat attached and supported at four points to a plurality of legs which can be collapsed into a compact bundle of substantially parallel parts b) a substantially trapezoidal flexible backrest connected to said seat through two tie straps separately attached at opposite sides of a bottom edge of said backrest, said tie straps further attached to two catercorner attachments points on said seat c) means for supporting said backrest from a single attachment point on a corner of said seat which is rearward of said catercorner attachment points of said tie straps so that i) said backrest is cantilevered over said seat with said backrest's top edge substantially positioned above a midpoint between said single attachment point and a diagonal line between said catercorner points, ii) said backrest is suspended in a plane substantially parallel with said diagonal line, and iii) said backrest, said tie straps and said supporting means can be adjusted to a nesting position with said legs and said seat and then compressed into a compact bundle of substantially parallel parts.

2. A lightweight, collapsible chair of claim 1, wherein said backrest and supporting means can be adjusted from a cantilevered position over said seat to a position under said seat to allow said seat and said legs to function as a stool.

3. A lightweight collapsible chair of claim 1, wherein said supporting means comprises a plurality of support members which are attached at one end to said single attachment point by a hinging means so that i) said support members when positioned over said single attachment point can angle apart to support said backrest at its upper edge, ii) said support members when positioned over said single attachment point and angled apart pivot laterally and substantially uniformly from said single attachment point iii) said support members can be rotated to a position below said seat and positioned parallel to leg members at close proximity for nesting and compressing into a compact bundle, and iv) said support members can be rotated to a position under said seat so that said seat and said legs can be used as a stool.

* * * * *